US010837251B2

(12) United States Patent
Foley et al.

(10) Patent No.: US 10,837,251 B2
(45) Date of Patent: Nov. 17, 2020

(54) POWER FEEDTHROUGH SYSTEM FOR IN-RISER EQUIPMENT

(71) Applicant: OneSubsea IP UK Limited, London (GB)

(72) Inventors: Brian L. Foley, Texas City, TX (US); David R. June, Houston, TX (US); Wayne C. Hand, Blackley Elland (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/970,948

(22) Filed: May 4, 2018

(65) Prior Publication Data

US 2018/0320470 A1 Nov. 8, 2018

Related U.S. Application Data

(60) Provisional application No. 62/502,409, filed on May 5, 2017.

(51) Int. Cl.

| | |
|---|---|
| ***E21B 17/00*** | (2006.01) |
| ***E21B 33/035*** | (2006.01) |
| ***E21B 33/038*** | (2006.01) |
| ***E21B 33/04*** | (2006.01) |
| ***E21B 34/04*** | (2006.01) |

(52) U.S. Cl.

CPC ..... *E21B 33/0385* (2013.01); *E21B 17/003* (2013.01); *E21B 33/0355* (2013.01); *E21B 33/0422* (2013.01)

(58) Field of Classification Search

CPC ..... E21B 33/0355; E21B 33/0385; E21B 33/0422; E21B 34/045; E21B 17/003; E21B 34/025

See application file for complete search history.

(56) References Cited

U.S. PATENT DOCUMENTS 6,082,460 A * 7/2000 June ..... E21B 33/04 166/348
6,200,152 B1 * 3/2001 Hopper ..... E21B 33/03 439/310
6,681,861 B2 * 1/2004 Davidson ..... E21B 33/0385 166/382
6,942,028 B2 * 9/2005 Hosie ..... E21B 33/047 166/88.4
6,974,341 B2 * 12/2005 Jennings ..... E21B 33/0385 439/140

(Continued)

OTHER PUBLICATIONS

Partial European Search Report for EP Application No. 18170878.5 dated Sep. 5, 2018; 12 pages.

(Continued)

*Primary Examiner* — Matthew R Buck
(74) *Attorney, Agent, or Firm* — Helene Raybaud

(57) ABSTRACT

A subsea system includes in-riser equipment, and a surrounding structure configured to be coupled to a marine riser and a subterranean well. The in-riser equipment is positioned within the surrounding structure, and the surrounding structure comprises a power connection extending radially therethrough. The system also includes a power supply located outside of the surrounding structure. The power supply is connected to the in-riser equipment via the power connection through the surrounding structure, to communicate with the in-riser equipment.

19 Claims, 6 Drawing Sheets

(56) References Cited

U.S. PATENT DOCUMENTS

| | | | | |
|---|---|---|---|---|
| 7,318,480 | B2 * | 1/2008 | Hosie | E21B 33/035 166/255.2 |
| 8,336,629 | B2 * | 12/2012 | Vaynshteyn | E21B 33/0355 166/344 |
| 8,443,899 | B2 * | 5/2013 | June | E21B 33/035 166/368 |
| 8,590,625 | B1 * | 11/2013 | Smith | E21B 33/0385 166/344 |
| 8,800,662 | B2 * | 8/2014 | Miller | E21B 34/045 166/250.01 |
| 9,273,531 | B2 * | 3/2016 | Tan | E21B 33/0422 |
| 9,376,873 | B2 | 6/2016 | Moss et al. | |
| 9,556,685 | B2 * | 1/2017 | Blanchard | E21B 17/01 |
| 9,593,561 | B2 * | 3/2017 | Xiao | E21B 43/12 |
| 2003/0141071 | A1 | 7/2003 | Hosie | |
| 2003/0153468 | A1 | 8/2003 | Soelvik | |
| 2005/0269096 | A1 * | 12/2005 | Milberger | E21B 33/043 166/308.1 |
| 2008/0110633 | A1 * | 5/2008 | Trewhella | E21B 33/038 166/336 |
| 2012/0097383 | A1 * | 4/2012 | Fenton | E21B 33/0385 166/65.1 |
| 2013/0056219 | A1 | 3/2013 | Miller | |
| 2015/0240585 | A1 * | 8/2015 | Mancuso | E21B 33/0355 166/338 |

OTHER PUBLICATIONS

Extended European Search Report for EP Application No. 18170878.5 dated Jan. 29, 2019; 11 pages.

European Office Communication (94(3) EPC for EP Application No. 18170878.5 dated Nov. 28, 2019; 5 pages.

* cited by examiner

POWER FEEDTHROUGH SYSTEM FOR IN-RISER EQUIPMENT

CROSS-REFERENCE TO RELATED APPLICATIONS

This application claims priority to U.S. Provisional Patent Application No. 62/502,409, which was filed on May 5, 2017 and is incorporated herein by reference in its entirety.

BACKGROUND

Offshore drilling and production systems often include a marine riser, a landing string, and a blowout preventer (BOP) stack, among other equipment and structures. The marine riser extends from surface equipment and down to the BOP stack, providing a conduit to the seabed, e.g., for the landing string to extend through. Landing strings are heavy-duty suspension systems used for installing equipment into a well. An individual landing string may include pipe and other tools connected to each other that aid in constructing and equipping a well. The landing string may be used, for example, for drilling and completing a well, to land tubing and casing strings in the well, or to land heavy equipment on the seabed.

The landing string may include a subsea test tree in some situations, which may be landed within the BOP stack. The subsea test tree generally includes one or more safety valves that can automatically shut-in a well. Furthermore, a variety of valves, sleeves, etc. may be run into the wellbore, e.g., as part of a production string. Components of the landing string, production string, subsea test tree, BOP stack, and/or other subsea components may thus be powered.

Hydraulic and/or electrical power may be delivered to such powered components from a surface control system by way of an umbilical. Normally, when a subsea test tree is utilized in subsea applications, the umbilical is lowered with the subsea test tree and contained within the marine riser. The umbilical is expensive, however, and could be damaged or broken during drilling or production operations, or otherwise lose the capability to supply power to the equipment located at the seabed or downhole. Moreover, the harsh, in-riser environment often results in a short lifecycle for such expensive umbilicals.

SUMMARY

Embodiments of the present disclosure may provide a system, including in-riser equipment, and a surrounding structure configured to be coupled to a marine riser and a subterranean well. The in-riser equipment is positioned within the surrounding structure, and the surrounding structure comprises a power connection extending radially therethrough. The system also includes a power supply located outside of the surrounding structure. The power supply is connected to the in-riser equipment via the power connection through the surrounding structure, to communicate with the in-riser equipment.

Embodiments of the disclosure may also provide a method including positioning wellhead equipment at a well, extending a riser from a surface structure to the wellhead equipment, positioning in-riser equipment within the wellhead equipment, and penetrating the wellhead equipment to connect a power supply through the wellhead equipment to the in-riser equipment, so as to communicate the power supply with the in-riser equipment.

Embodiments of the disclosure may further provide a system including an adapter joint, a tubing hanger running tool coupled to the adapter joint, a tubing hanger coupled to the tubing hanger running tool, a marine riser, a spoolbody coupled to the marine riser, and a wellhead coupled to the spoolbody. The spoolbody and the wellhead together define at least a portion of a conduit that communicates with an interior of the marine riser. The adapter joint, the tubing hanger running tool, and the tubing hanger are positioned within the conduit, and wherein the conduit fluidly communicates with a well. The system also includes a penetrator extending through a wall of the spoolbody and configured to form a connection through the spoolbody so as to provide electrical or hydraulic communication through the spoolbody and to at least one of the adapter joint, the tubing hanger running tool, and the tubing hanger positioned within the spoolbody.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits and networks have not been described in detail so as not to obscure aspects of the embodiments.

It will also be understood that, although the terms first, second, etc. may be used herein to describe various elements, these elements should not be limited by these terms. These terms are used to distinguish one element from another. For example, a first object could be termed a second object, and, similarly, a second object could be termed a first object, without departing from the scope of the invention.

The first object and the second object are both objects, respectively, but they are not to be considered the same object.

The terminology used in the description of the invention herein is for the purpose of describing particular embodiments and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques and workflows that are in accordance with some embodiments. Some operations in the processing procedures, methods, techniques and workflows disclosed herein may be combined and/or the order of some operations may be changed.

Figure 1:
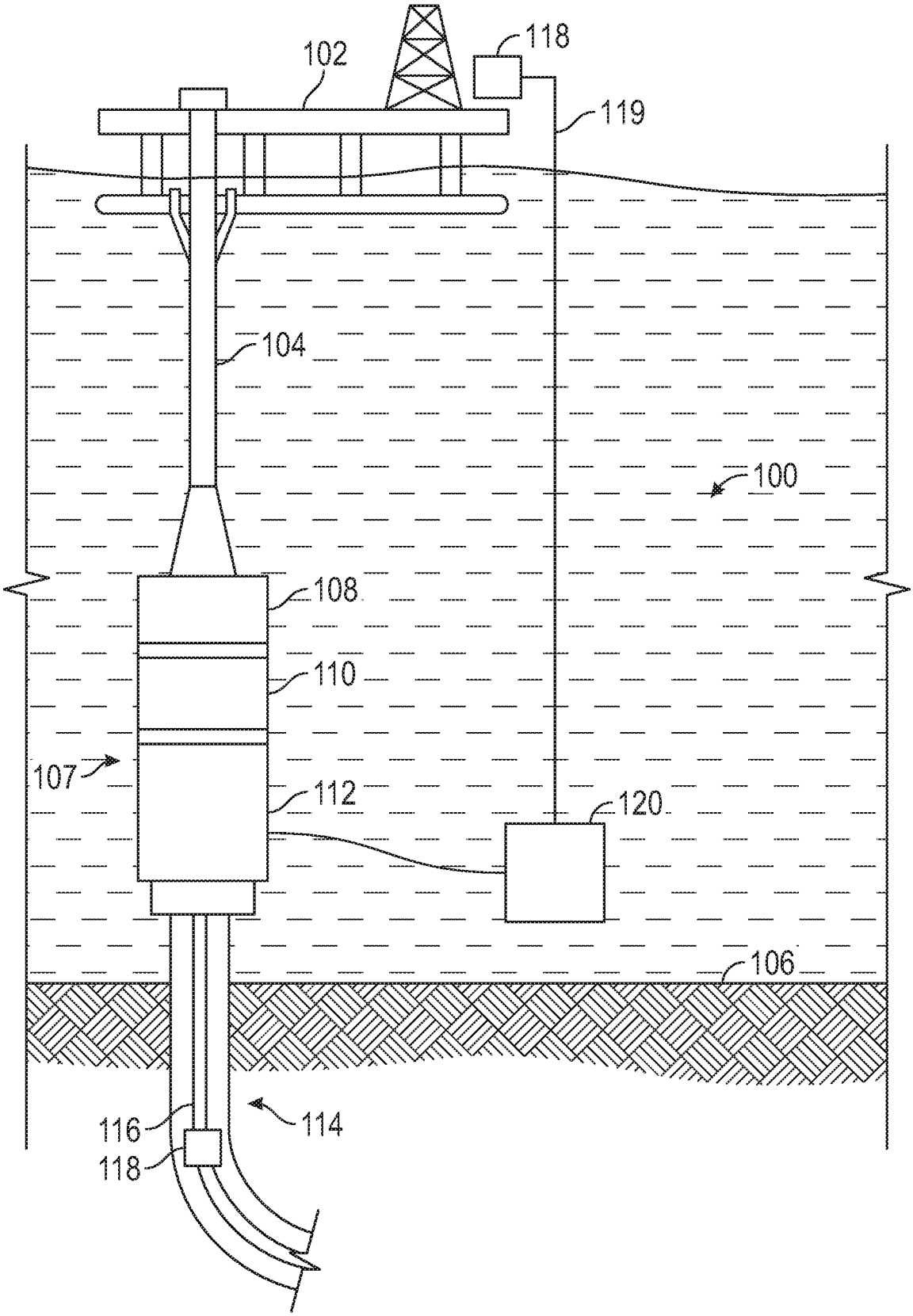
FIG. 1 illustrates a conceptual view of an offshore drilling and/or production system, according to an embodiment.

FIG. 1 illustrates a conceptual view of an offshore drilling and/or production system 100, according to an embodiment. The system 100 may be provided in various configurations and adapted for well drilling, intervention, installation, completion, and/or workover operations. The system 100 may generally include a platform 102 that may be positioned at or near the surface of a body of water, such as the ocean. The system 100 may also include a marine riser 104, which may extend downwards from the platform 102 toward the seabed 106. Proximal to the seabed 106, the marine riser 104 may connect with subsea wellhead equipment 107. For example, the wellhead equipment 107 may include a blowout preventer (BOP) stack 108, a function spoolbody or tree (hereinafter, referred to as a spoolbody) 110, and a wellhead 112. The spoolbody 110 may be permanent or temporary depending on the functions the spoolbody 110 serves, such as a tree body, tubing head spool, adapter spool, connector body, and BOP member. In some embodiments, the spoolbody 110 may be a subsea Christmas tree.

Each of the in-riser equipment components may be connected together and may include an internal conduit. Once connected together, the internal conduits may together provide a central conduit extending through the wellhead equipment 107, connecting the riser 104 to a well 114 therethrough. As such, the wellhead equipment 107 may provide a surrounding structure through which other components (e.g., strings, hangers, trees, etc.) may be run and/or landed.

The well 114 may extend through the seabed 106 into the earth from the wellhead 112. The well 114 may be vertical, horizontal, or deviated. A work string 116 may extend through the wellhead 112 into the well 114, as shown. The work string 116 may include components configured to be positioned within the well, referred to as "downhole" components. Once such downhole component 118 is illustrated as part of the work string 116. Such downhole components may include sliding sleeves, valves, sensors, controllers, transmitters, etc., at least some of which may be powered.

The system 100 may not include an internal (in-riser) umbilical, in at least some embodiments, or may include a reduced-function in-riser umbilical. Thus, power may be supplied from a power source 118 through an external umbilical 119 to a power supply 120. The power supply 120 may be external to the wellhead equipment 107 and, in some embodiments, may be physically coupled thereto. In some embodiments, the power supply 120 may be part of the BOP stack 108, spoolbody 110, or wellhead 112, or another structure. Thus, rather than through an in-riser umbilical, power may be supplied to equipment within the riser 104 and/or within the wellhead equipment 107 from the power supply 120 positioned proximal to the seabed 106 and external to the riser 104. In some embodiments, the power supply 120 may be independent of the surface equipment (e.g., a battery), and thus the reduced-function umbilical 119 may also be omitted.

In other embodiments, the external umbilical 119 may be connected directly to the wellhead equipment 107, and thus the power supply 120 may be internal to one or more components thereof. In other embodiments, the power supply 120 may be provided by in-riser equipment, such as a subsea test tree, that is landed in the conduit that extends through the wellhead equipment 107, as mentioned above.

The power supply 120 may be employed to provide power to components within the wellhead equipment 107 and/or to the downhole component 118. The power supply 120 may communicate such power through the wellhead equipment 107 via a connection that extends at least partially radially through one or more components of the wellhead equipment 107.

Figure 2:
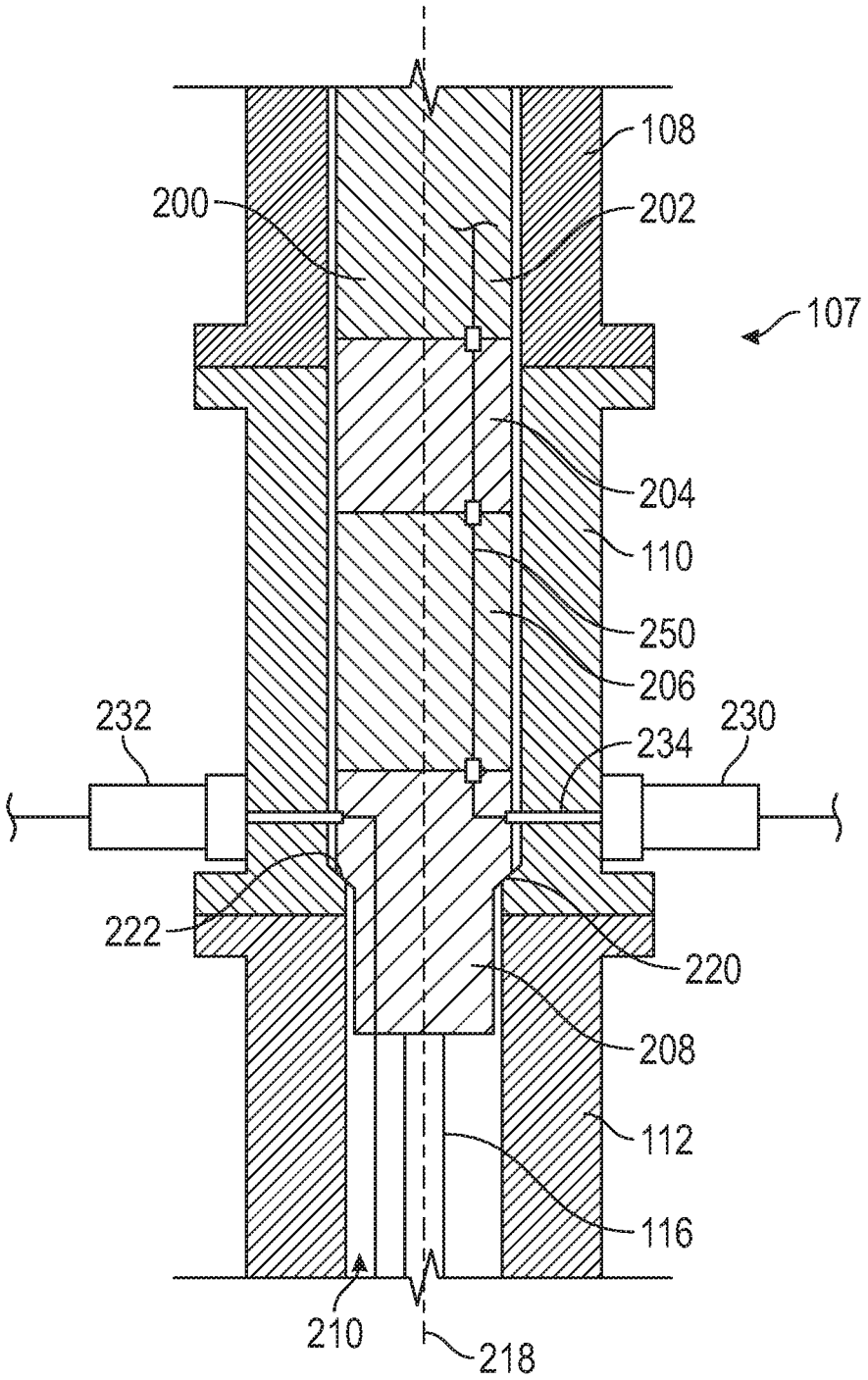
FIG. 2 illustrates a side, cross-sectional view of wellhead equipment and in-riser equipment, according to an embodiment.

FIG. 2 illustrates a cross-sectional view of the wellhead equipment 107, showing in-riser equipment 200 therein, according to an embodiment. The in-riser equipment 200 may be part of a landing string. In the illustrated example, the in-riser equipment 200 includes a subsea test tree (SSTT) 202, an adapter joint 204, a tubing hanger running tool (THRT) 206, and a tubing hanger 208. The in-riser equipment 200 is positioned within a central conduit 210 that runs through the wellhead equipment 107, when the wellhead equipment 107 is attached together. The central conduit 210 may be cylindrical, defining a central longitudinal axis 218 (up and down, in this view). Directions referred to herein as "axial" are parallel to this central longitudinal axis 218, while "radial" directions are perpendicular thereto (e.g., left or right in this view).

In this specific embodiment, the tubing hanger 208 may include a shoulder 220, which may be sized to land against a complementary shoulder 222 of the spoolbody 110. This may result in fixing the position of the in-riser equipment 200 (and any tubulars, such as casing, that are hung therefrom) with respect to the wellhead equipment 107. The THRT 206 may be positioned above the tubing hanger 208, the tubing hanger adapter joint 204 may be above the THRT 206, and the SSTT 202 may be above the THRT 206. In some embodiments, one or more other components may be positioned between the illustrated components of the in-riser equipment 200, or these components may be directly connected together without intervening components.

The wellhead equipment 107 may also include one or more penetrators (two shown: 230, 232). The penetrators 230, 232 may each include an extendible connector 234, which may be driven by an actuator, such as a hydraulic actuator, and configured to penetrate through a wall of the wellhead equipment 110 and potentially at least a portion of one of the pieces of in-riser equipment 200. The penetrator 230, 232 may thus provide a connection between the power supply 120 (see FIG. 1) and the in-riser equipment 200. In this embodiment, the penetrators 230, 232 are connected to the tree or spoolbody 110 and, once the extendible connectors 234 thereof are extended, provide a connection with the tubing hanger 208 landed therein.

The penetrators 230, 232 may be powered hydraulically, pneumatically, or electrically. In some embodiments, the power that is transmitted to the in-riser equipment 200 from the power supply 120 may be the same power that is used to actuate the penetrators 230, 232 to penetrate the wellhead equipment 107. Thus, if the power supply 120 is providing hydraulic pressure to the in-riser equipment 200, the penetrators 230, 232 may likewise be hydraulically energized. Any convenient type of penetrator that is suitable for the function described above may be used for the penetrators 230, 232.

During deployment of the wellhead equipment 107 and/or deployment of the in-riser equipment 200 to within the wellhead equipment 107, the penetrators 230, 232 may be retracted. Upon landing and assembling the wellhead equipment 107 and the in-riser equipment 200, the penetrators 230, 232 may be actuated, causing the extendible connectors 234 thereof to penetrate into the wellhead equipment 107 and potentially into the in-riser equipment 200 and thereby provide the connection between the power supply 120 that is external to the riser 104 and the in-riser equipment 200.

One or more lines (two shown: 250, 252) may extend from the connections formed by the penetrators 230, 232. The lines 250, 252 may be configured to conduct power and/or control signals. The lines 250, 252 may either run up, toward in-riser or landing string components, or downward into the well 114. For example, the line 250 may run from the connection with the penetrator 230, through the tubing hanger 208, up through the THRT 206, adapter joint 204, and to the SSTT 202. Further, the line 250 may include connections between and/or with THRT 206 and adapter joint 204, and may supply power thereto, e.g., selectively as called for. In this embodiment, the other line 252 may extend from the connection with the penetrator 232, downwards through the tubing hanger 208 and along (or in, as part of, etc.) the work string 116 to the downhole component 118.

Figure 3:
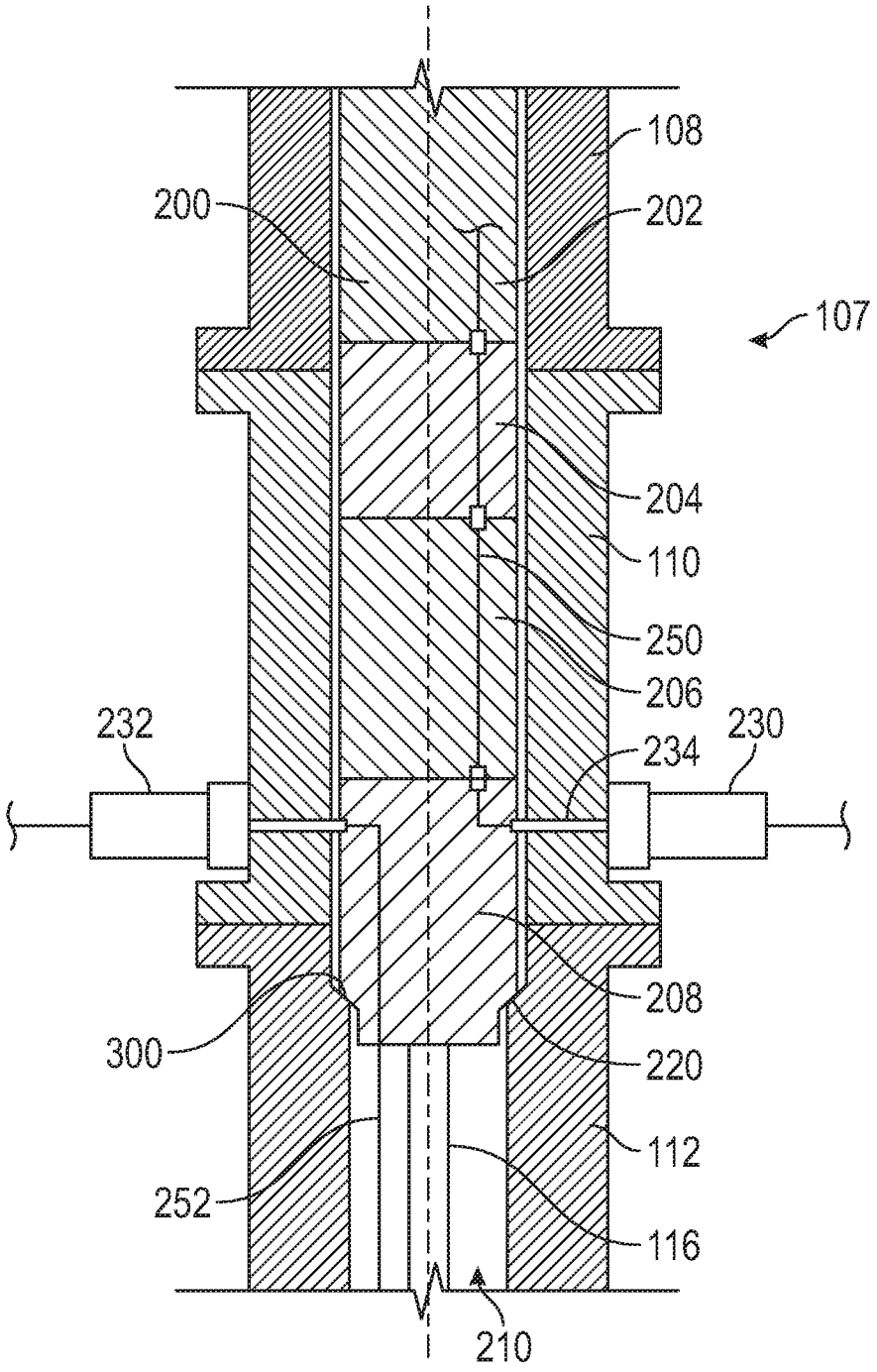
FIG. 3 illustrates a side, cross-sectional view of wellhead equipment and in-riser equipment, according to another embodiment.

FIG. 3 illustrates a side, cross-sectional view of the wellhead equipment 107 and the in-riser equipment 200, according to another embodiment. The embodiment of FIG. 3 is similar to the embodiment of FIG. 2, except that the tubing hanger 208 engages and is landed in the wellhead 112 rather than the spoolbody 110. Thus, as shown, for example, the shoulder 220 may land on a shoulder 300 formed in the wellhead 112.

Figure 4:
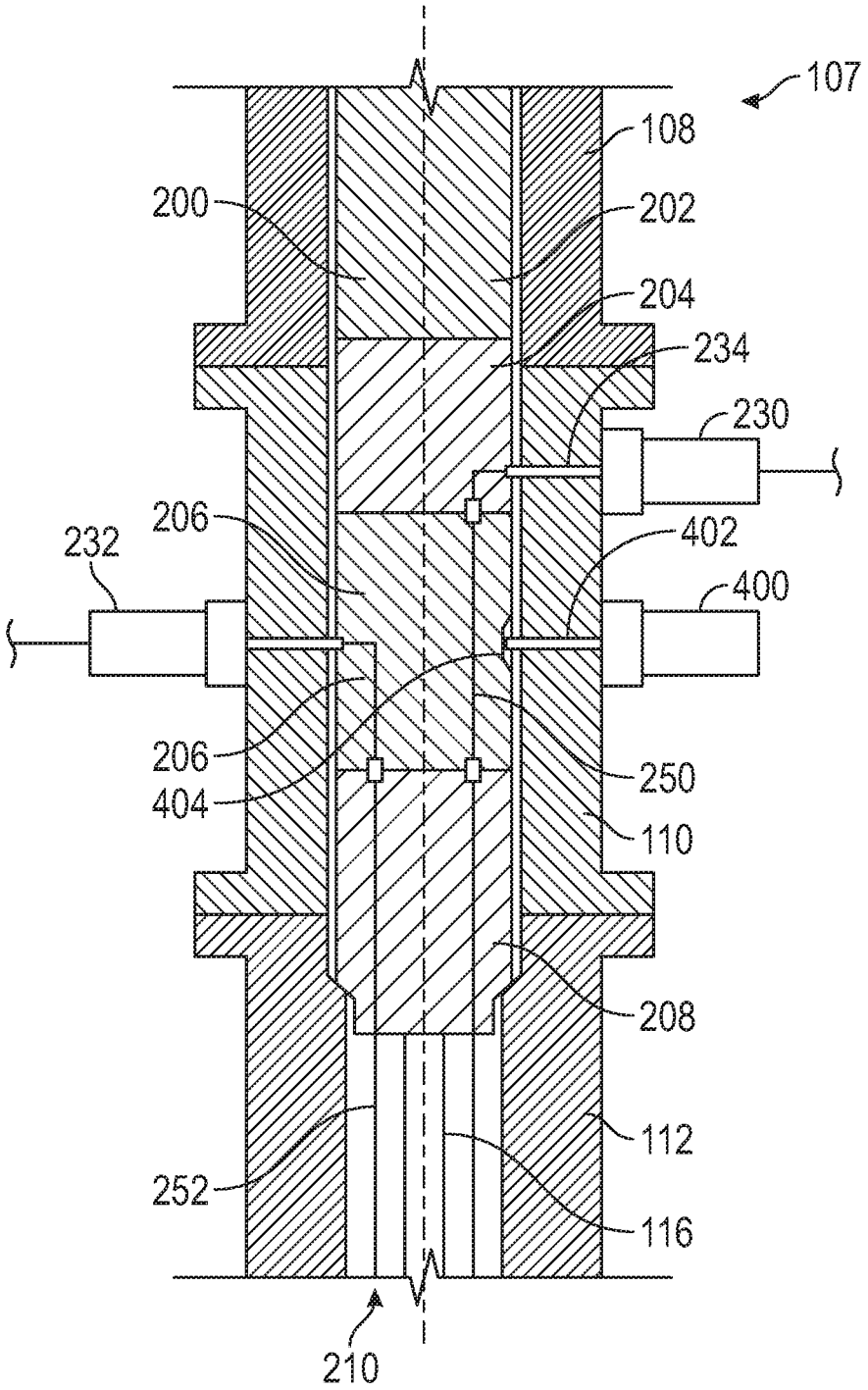
FIG. 4 illustrates a side, cross-sectional view of wellhead equipment and in-riser equipment, according to another embodiment.

FIG. 4 illustrates a side, cross-sectional view of the wellhead equipment 107 and the in-riser equipment 200, according to another embodiment. The embodiment of FIG. 4 is similar to the embodiment of FIG. 3 but has several differences. First, the wellhead equipment 107, e.g., the spoolbody 110, includes an angular alignment apparatus 400. The angular alignment apparatus 400 may include a lug (e.g., a pin) 402 that extends radially inward into the conduit 210 from the spoolbody 110. For example, the lug 402 may extend entirely through a wall of the spoolbody 110 and into the conduit 210. The lug 402 may be stationary, or may be deployed, similar to the extendible connector 234 of the penetrators 230, 232, when desired. The lug 402 may be configured to fit into a slot 404, e.g., formed in the THRT 206 (or another component of the in-riser equipment 200). The slot 404 may, in some embodiments, extend helically about the in-riser equipment 200, and thus, by interaction with the stationary lug 402 causes the in-riser equipment 200 to rotate to a desired orientation when the THRT 206 is lowered axially along with the rest of the in-riser equipment 200.

In some embodiments, the lug 402 may extend outwards from the THRT 206 and the slot 404 may be formed in the spoolbody 110 (or another component of the wellhead equipment 107). It will be appreciated that the lug/slot embodiment is merely an example of one apparatus 400 configured to provide angular alignment of the in-riser equipment 200 with respect to the wellhead equipment 107 in the conduit 210.

In addition, still referring to the embodiment of FIG. 4, the penetrator 230 may be aligned with the adapter joint 204 when the in-riser equipment 200 is positioned in the wellhead equipment 107. As such, the line 250 may extend downward through the in-riser equipment 200, from the adapter joint 204. In some embodiments, the in-riser equipment 200 may not include the SSTT 202, or the SSTT 202 may include an independent power supply, and thus a power line extending thereto from the power supply 120 may be omitted. Furthermore, the penetrator 230 may be positioned on the wellhead equipment 107 (e.g., on the spoolbody 110) so as to form a connection with the adapter joint 204, generally toward the top of the in-riser equipment 200. The line 250 may thus run downward from the adapter joint 204, to/through the THRT 206, to/through the tubing hanger 208, and then downhole along, in, or as part of the work string 116, so as to connect with the downhole component 118 (FIG. 1).

Figure 5:
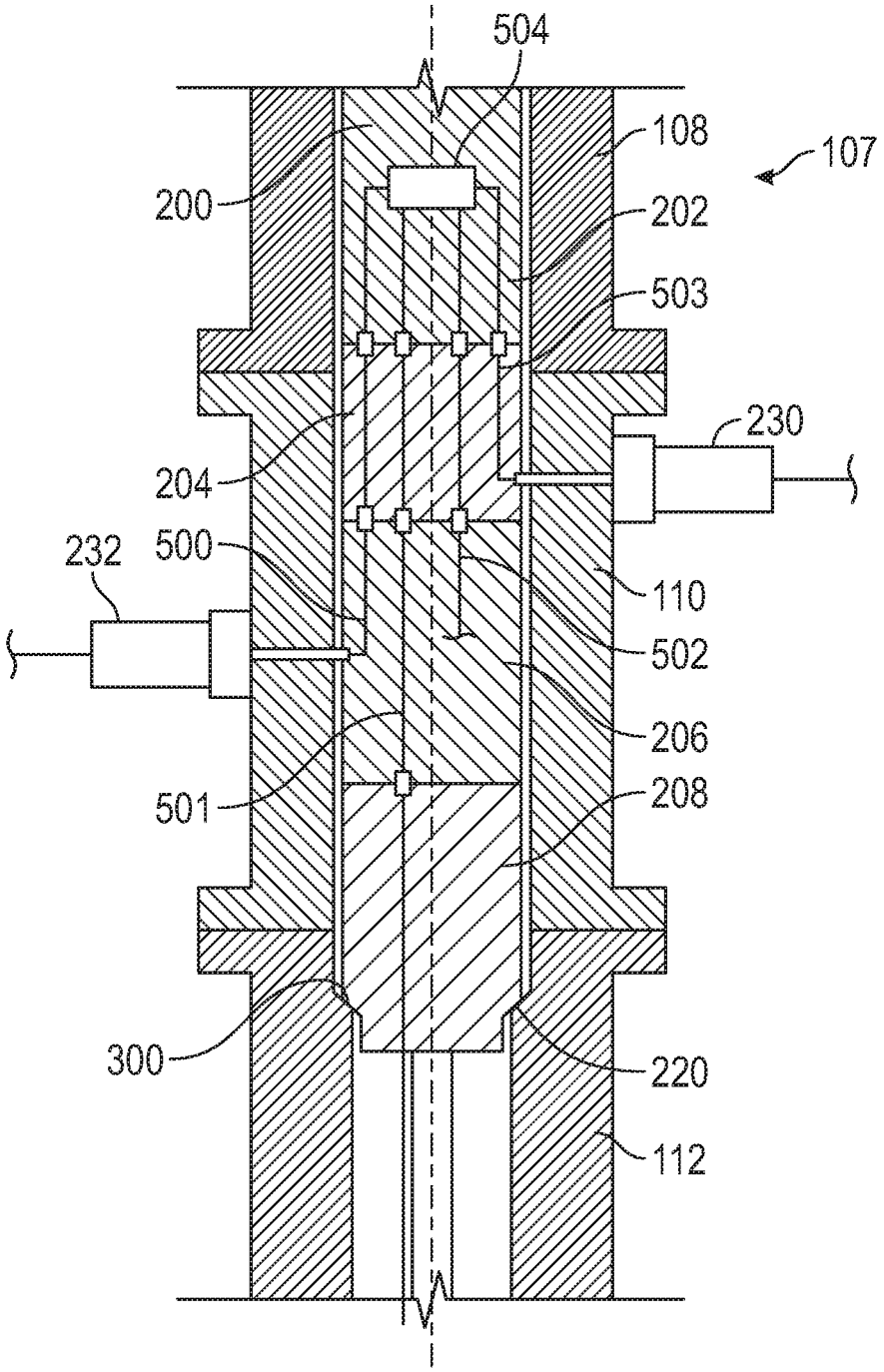
FIG. 5 illustrates a side, cross-sectional view of wellhead equipment and in-riser equipment, according to another embodiment.
Figure 6:
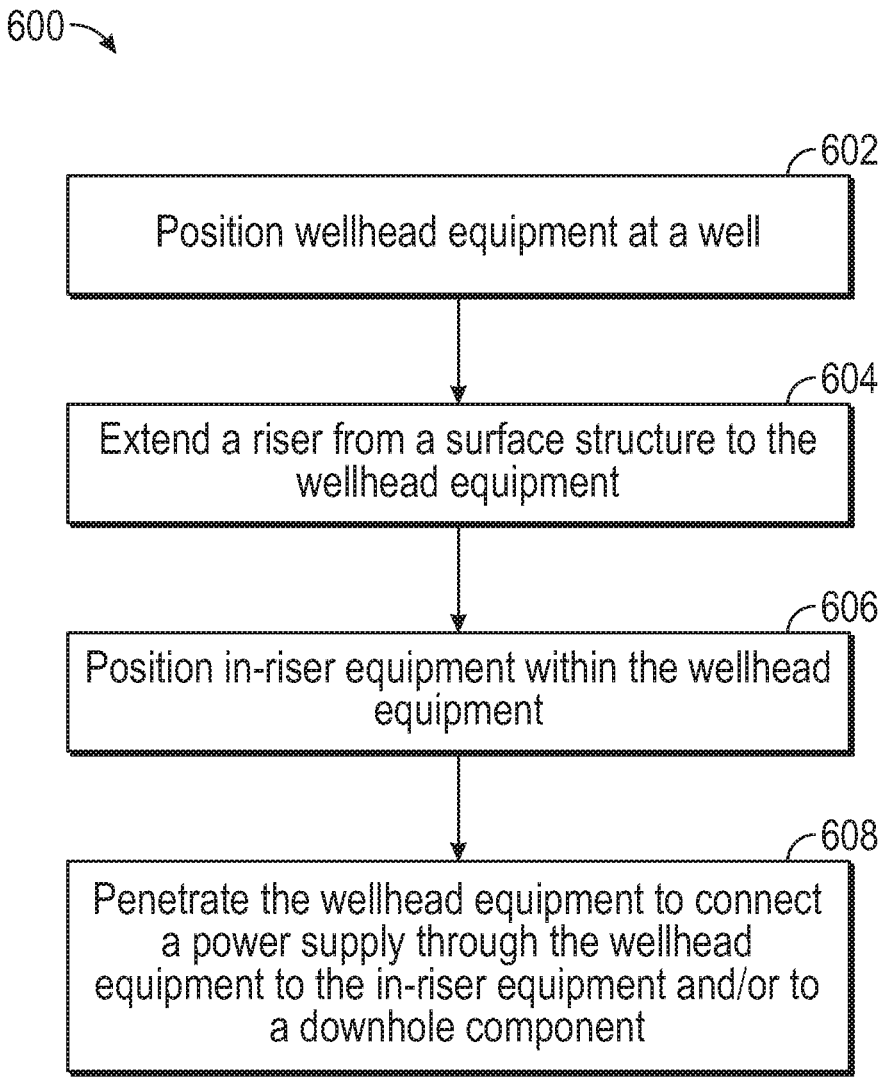
FIG. 6 illustrates a flowchart of a method for providing power to in-riser equipment, according to an embodiment.

FIG. 5 illustrates a side, cross-sectional view of the wellhead equipment 107 and the in-riser equipment 200, according to an embodiment. The embodiment of FIG. 5 is similar to the embodiment of FIG. 3, but includes a different set of lines within the in-riser equipment 200. In particular, the in-riser equipment 200 includes four lines 500, 501, 502, 503, each of which is connected to a controller 504 that is contained within the SSTT 202, another landing string component, or another in-riser device. The controller 504 may be coupled with the power supply 120 via the line 500 and/or the line 503. The lines 500 and 503 may extend to the penetrators 232, 230, respective, in order to connect to the power supply 120 through the spoolbody 110. The lines 501, 502 extend downward to/through the landing string components and potentially to the downhole component 118 (FIG. 1).

With reference to FIGS. 1-5, FIG. 6 illustrates a flowchart of a method 600 for providing power through wellhead equipment 107 to in-riser equipment 200, according to an embodiment. The method 600 may include positioning the wellhead equipment 107 at a well 114, as at 602. The method 600 may further include extending a riser from a surface structure to the wellhead equipment, as at 604. The method 600 may then proceed to positioning in-riser equipment 200 within the wellhead equipment 107, as at 606.

The method 600 may further include penetrating through the wall of the wellhead equipment 107 to connect a power supply 120 through the wellhead equipment 107 to the in-riser equipment 200, as at 608. In an embodiment, penetrating the wellhead equipment 107 may include actuating a penetrator 230, 232, which may be coupled to the wellhead equipment 107, e.g., to the spoolbody 110. The penetrator 230, 232 extends an extendible connector 234 radially through a wall of the wellhead equipment 107 and into communication with the in-riser equipment 200, in response to being actuated. In some embodiments, the power supply 120 comprises an electrical power supply or a hydraulic power supply. The power supply 120 may be provided as part of a subsea test tree 202, a subsea Christmas tree, a spoolbody 110, a blowout preventer stack 108, or a tubing head spool. Further, the power supply 120 may be positioned outside of the conduit 210, and thus outside of the in-riser environment, and may be proximal to the well 114, e.g., at the seabed 106

Accordingly, the systems and methods disclosed herein may provide electrical power or hydraulic power to a subsea safety tree (SSTT), a tubing hanger running tool (THRT), a tubing hanger (TH), an adapter joint, or to any powered devices within a landing string and/or downhole within the well. The power supply may extend from a subsea Christmas tree (SXT), a spacer spool, a blowout preventer (BOP) stack, or from another external power supply outside of the riser. The system may include an electrical penetrator or horizontal couplers that supply power to the landing string from the external power supply.

The system and method disclosed herein may support an umbilical-less or reduced function umbilical for a tubing hanger landing string or other in-riser equipment by providing power and/or communication from an external source such as a subsea Christmas tree, a spacer spool, a BOP stack, a tubing head spool, or any other wellhead member that is temporarily or permanently installed for the purpose of alignment or support. The equipment located in the riser that uses the power may include a tubing hanger, a tubing hanger running tool, a subsea test tree, an adapter joint, or associated equipment using power to operate subsea functions within the riser.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A system, comprising:

in-riser equipment, the in-riser equipment comprising:

a first component;

a second component; and a controller within the in-riser equipment, the controller comprises a plurality of input connections and a plurality of output connections to control power distribution to the in-riser equipment;

a surrounding structure configured to be coupled to a marine riser and a subterranean well, wherein the in-riser equipment is positioned within the surrounding structure, wherein the surrounding structure comprises a first power connector extending radially therethrough and a second power connector extending radially therethrough, and wherein the first power connector is configured to couple mechanically and directly to the first component and the second power connector is configured to couple mechanically and directly to the second component; and a power supply located outside of the surrounding structure, wherein the power supply is connected to the controller in the in-riser equipment via the first power connector and the second power connector through the surrounding structure, to communicate with the in-riser equipment.

2. The system of claim 1, wherein the in-riser equipment comprises a tubing hanger, and wherein the surrounding structure comprises a wellhead, and wherein the tubing hanger is configured to engage the wellhead.

3. The system of claim 2, wherein the surrounding structure further comprises a spoolbody having an alignment apparatus, and wherein the in-riser equipment further comprises a tubing hanger running tool, the alignment apparatus being engageable with the tubing hanger running tool so as to angularly orient the in-riser equipment with respect to the surrounding structure.

4. The system of claim 1, wherein the in-riser equipment comprises a tubing hanger, wherein the surrounding structure comprises a spoolbody, and a wellhead coupled to the spoolbody, and wherein the tubing hanger is configured to engage the spoolbody.

5. The system of claim 1, wherein the in-riser equipment comprises a subsea test tree.

6. The system of claim 5, wherein the power supply is provided to or through the subsea test tree, or a blowout preventer stack, or a tubing head spool.

7. The system of claim 5, wherein the subsea test tree comprises the controller that is in communication with the power supply.

8. The system of claim 7, wherein the in-riser equipment further comprises an adapter joint, a tubing hanger running tool, a tubing hanger positioned within the surrounding structure, and wherein the controller is in communication with at least one of the tubing hanger running tool or the tubing hanger, such that the controller provides power thereto.

9. The system of claim 5, further comprising one or more power lines positioned at least partially within the surrounding structure and in communication with the first power connector, the second power connector, and one or more downhole tools positioned in the subterranean well.

10. The system of claim 1, wherein the first power connector and/or the second power connector comprise a penetrator comprising an extendible connector that is configured to penetrate at least a portion of the surrounding structure.

11. The system of claim 10, wherein the in-riser equipment further comprises an adapter joint, a tubing hanger running tool connected to the adapter joint, and a tubing hanger connected to the tubing hanger running tool and positioned within the surrounding structure, and wherein the penetrator is configured to penetrate into the adapter joint.

12. A method, comprising:

positioning wellhead equipment at a well;

extending a riser from a surface structure to the wellhead equipment;

positioning in-riser equipment within the wellhead equipment, the in-riser equipment comprises a controller with a plurality of input connections and a plurality of output connections;

penetrating the wellhead equipment with a power connector to connect a power supply through the wellhead equipment to the controller in the in-riser equipment, so as to communicate the power supply with the in-riser equipment; and controlling the power supply to the in-riser equipment with the controller.

13. The method of claim 12, wherein penetrating the wellhead equipment with the power connector comprises actuating a penetrator, wherein the penetrator extends a connector radially through a wall of the wellhead equipment and into communication with the in-riser equipment.

14. The method of claim 12, wherein the power supply comprises an electrical power supply or a hydraulic power supply.

15. A system, comprising:

a subsea test tree comprising a controller the controller comprises a plurality of input connections and a plurality of output connections configured to control power distribution;

an adapter joint coupled to the subsea test tree;

a tubing hanger running tool coupled to the adapter joint;

a tubing hanger coupled to the tubing hanger running tool, the tubing hanger defining a shoulder;

a marine riser;

a spoolbody coupled to the marine riser;

a wellhead coupled to the spoolbody, wherein the spoolbody and the wellhead together define at least a portion of a conduit that communicates with an interior of the marine riser, wherein the subsea test tree, the adapter joint, the tubing hanger running tool, and the tubing hanger are positioned within the conduit, wherein the conduit fluidly communicates with a well, and wherein the shoulder of the tubing hanger is configured to contact a corresponding surface on the wellhead; and a penetrator extending through a wall of the spoolbody and configured to form a connection through the spoolbody so as to provide electrical or hydraulic communication through the spoolbody to the controller in the subsea test tree to communicate with at least one of the subsea test tree, the adapter joint, the tubing hanger running tool, and the tubing hanger positioned within the spoolbody, wherein the penetrator is vertically offset from the shoulder of the tubing hanger in a set position.

16. The system of claim 15, further comprising a power supply positioned exterior to the marine riser, wherein the power supply communicates with the at least one of the subsea test tree, the adapter joint, the tubing hanger running tool, or the tubing hanger via the connection through the spoolbody.

17. The system of claim 15, further comprising one or more lines extending from the penetrator and through at least one of the subsea test tree, the tubing hanger running tool, or the tubing hanger.

18. The system of claim 17, wherein at least one of the one or more lines extends into the well to which the wellhead is connected, and to a downhole tool.

19. The system of claim 15, wherein the tubing hanger is positioned within and landed on the wellhead.

* * * * *